United States Patent [19]

Sumida

[11] 3,958,622

[45] May 25, 1976

[54] APPARATUS FOR CONTINUOUSLY MANUFACTURING ENDLESS LEAD SHEET

[75] Inventor: Tokunobu Sumida, Takehara, Japan

[73] Assignee: Mitsui Mining & Smelting Co., Ltd., Tokyo, Japan

[22] Filed: Nov. 15, 1974

[21] Appl. No.: 524,306

Related U.S. Application Data

[62] Division of Ser. No. 443,636, Feb. 19, 1974.

[30] Foreign Application Priority Data

Feb. 23, 1973 Japan ..... 48-23478[U]

[52] U.S. Cl. ..... 164/276; 137/574

[51] Int. Cl.[2] ..... B22D 11/06

[58] Field of Search ..... 164/87, 134, 276; 137/563, 573, 574, 577

[56] References Cited

UNITED STATES PATENTS

| | | | |
|---|---|---|---|
| 1,120,351 | 12/1914 | Weston | 137/573 X |
| 2,069,485 | 2/1937 | Sweet | 164/87 |
| 2,074,812 | 3/1937 | Sendzimir | 164/87 |
| 3,599,705 | 8/1971 | McDougal et al. | 164/87 |
| 3,654,150 | 4/1972 | Eccles | 164/134 X |
| 3,858,642 | 1/1975 | Battiston et al. | 164/276 |

*Primary Examiner*—Robert D. Baldwin
*Assistant Examiner*—Gus T. Hampilos
*Attorney, Agent, or Firm*—Armstrong, Nikaido & Wegner

[57] ABSTRACT

Apparatus for continuously manufacturing an endless lead sheet from which a cathode starting sheet to be used in electrolytic refining of lead is prepared are disclosed. In the present method, molten lead is continuously introduced into a first separation zone where dross is caused to come up to the surface and separated from the molten lead, mixture of the dross and the molten lead in the vicinity of the melt surface is introduced into a second separation zone through a wide flow path, and the molten lead substantially free from the dross is introduced into a casting zone while the dross is accumulated on the liquid surface in the second separation zone. In the present apparatus, there is provided in a casting tank a dish surrounding a bottom of a rotary cooling drum, which dish includes a laterally extending, shallow cutout at an upper end thereof. An adjustable gate device is provided between the cutout and the bottom of the drum.

4 Claims, 2 Drawing Figures

APPARATUS FOR CONTINUOUSLY MANUFACTURING ENDLESS LEAD SHEET

Figure 1:
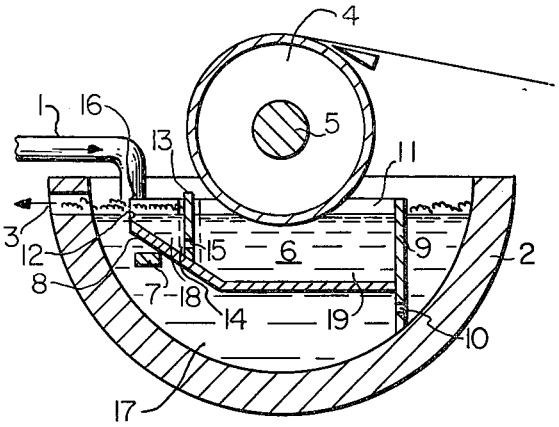

This is a division of application Ser. No. 443,636, filed Feb. 19, 1974.

The present invention relates to the preparation of a starting sheet for a lead cathode to be used in lead electrolytic refining in a so-called Betts process, and more particularly relates to a method for preparing a thin endless lead sheet, from which the starting sheet for the lead cathode is cut out, by casting highly pure molten lead on a rotating drum, and to an improvement of the casting apparatus therefor.

There has been used an electrolytic refining process, so-called Betts process, in order to refine lead bullion including bismuth which is difficult to refine in a conventional pyrometallurgical process. In the process, lead of 99.99 % purity is prepared by an electrolysis carried out in electrolyte comprising an aqueous solution of lead fluorosilicate ($P_b$ $SiF_6$) and free fluorosilicic acid ($H_2SiF_6$) with an anode of a cast lead bullion to be refined and a cathode of a thin sheet of highly pure lead, usually electrolytic lead, to deposit the lead in the bullion on the cathode.

The Betts process, however, has a disadvantage in that refining cost is more expensive than that required in the pyrometallurgical refining process. One of the approaches to overcome the cost problem is to make an electrolitic cell large size without decreasing the electric current efficiency.

In order to carry out the Betts process smoothly, it is important that thin cathode starting sheets of 0.5 – 1 mm thickness are hung vertically in an electrolitic cell. The deformation of a multiple of anode and cathode plates each hung in the electrolyte in opposing relation to each other causes short-circuiting of current and deflection of current which result in the reduction of electric current efficiency. Especially, those cathode starting sheets which are cut out of an endless lead sheet manufactured by casting molten lead on a rotating drum, although they are subjected to pressure shaping, frequently deviate from a hanging beam. The larger the size of the cathode starting sheet, the more is the amount of deformation. Thus, this is one of the factors for making it difficult to carry out the Betts process in a large-size electrolitic cell although the above casting process is the best one that makes the mass production on industrial basis feasible.

The endless lead sheet is manufactured in the casting process by melting highly pure lead which is usually electrolytic lead, casting the molten lead on a rotating casting drum which is partially dipped in the molten lead and cooled, stripping the cast lead and winding it onto a take-up roll.

In this casting process, if the thickness of the cast lead sheet is irregular or not uniform, it is so difficult to take up the sheet from the casting drum that the operation is interrupted. The lack of uniformity of the thickness of the sheet may result from slight change in take-up tension due to increased sheet width, unsuitable cooling, dipping depth of the drum rotating speed thereof, the lack of uniform deposition of the molten lead, etc. In addition, the dross having been produced by the contact of the molten lead with air comes to the surface of the molten lead, which dross deposits on the casting drum and wound with the sheet resulting in localized protrusions which, in turn, cause the lack of uniformity in the sheet thickness. When the sheet having irregular thickness is rolled up, the sheet tends to deviate from the winding direction and run beyond one end of the winding roll. If end plates are attached at the ends of the roll the sheet is folded at the portions where the sheet makes contact with the end plates and the operation has to be eventually interrupted. Furthermore, the sheet wound in this manner may be broken during unwinding, or even if it is not broken the cathode starting sheet cut out of such sheet and shaped cannot be held vertically in correct manner in the electrolyte.

It is an object of the present invention to provide a method for carrying out casting in high efficiency without depositing the dross on a casting sheet.

It is another object of the present invention to provide an apparatus for effecting casting while keeping the dross away from the casting drum.

It is a further object of the present invention to provide a method for manufacturing a starting sheet having a uniform thickness for cathode which allows to make the electrolitic cell for the Betts process large in size.

According to the present invention, an improvement is provided in a continuous method for manufacturing an endless lead sheet for a cathode starting sheet to be used in electrolytic refining of lead which comprises casting the molten lead including the dross onto a rotating drum and taking-up the cast lead sheet, which improvement comprising the steps of continuously introducing the molten lead to a first separation zone, floating the dross up to separate it from the molten lead, introducing the molten lead which is adjacent to the interface between the dross and the molten lead together with the dross into a second separation zone at substantially same liquid level through a wide flow path, introducing the molten lead which is substantially free from the dross into a casting zone, effecting the casting, while accumulating the dross on the liquid surface in the second separation zone.

According to the improvement of the present invention, the molten lead including the dross is fed from a melting kettle to the first separation zone continuously by, for example, a pump. The first separation zone comprises a heat insulated bath where most of the dross comes to the surface to be separated from the molten lead. The floated dross together with the molten lead in the vicinity of the melt surface is introduced into the second separation zone where certain amount of the dross may sink during the introduction but comes again to the surface so that the molten lead which is substantially free from the dross is taken out of the bottom of the zone, which is then supplied to the casting zone while the lead consumed by casting is supplemented.

The feature of the present method resides in the steps of introducing the molten lead of shallow surface layer in the melt in the first separation zone on which the dross is floating into the second separation zone, where the dross is further caused to come to the surface to allow to introduce the molten lead which is substantially free from the dross from the bottom of the second zone to the casting zone. This can be readily accomplished by maintaining the level difference between the first and second separation zones and the level difference between the second separation zone and the casting zone, respectively, to minimum and introducing the molten lead and dross in the vicinity of the interface therebetween from the first separation zone to the second separation zone through the wide flow path.

Figure 2:
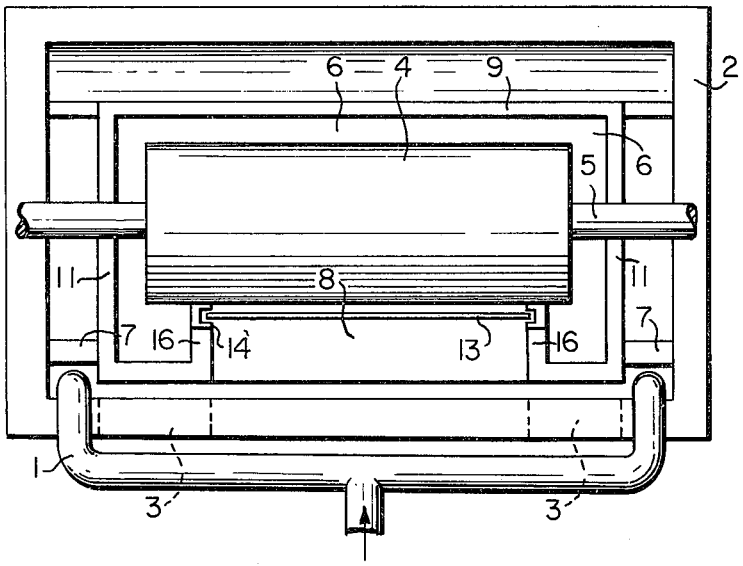

The preferred embodiments of the present invention will now be described with reference to the accompanying drawings which illustrate a casting apparatus suitable to implement the present invention, in which;

FIG. 1 shows a cross sectional view of the apparatus filled with molten lead, and FIG. 2 shows a plane view of the empty apparatus.

Referring to the drawings, the molten lead including the dross is introduced via a conduit 1 to liquid in the casting apparatus surrounded by a heat insulating enclosure 2, which, in turn, is provided with a liquid return ports 3 for maintaining the liquid level at a fixed level. A casting drum 4 having its bottom dipped below the liquid surface is supported by a suitable supporting means. The drum 4 can be rotated by an appropriate drive means while being cooled by a water cooling pipe 5. Mounted between the casting drum 4 and the enclosure 2 is a dish 6. One end of the dish 6 which is parallel to the axis of the drum 4 forms a separating wall 8 which, in turn, is supported by a support member 7 mounted on an inner wall of the enclosure 2, and the other end of the dish 6 forms a vertical separating wall 9 having its bottom mounted to the bottom of the enclosure 2. A throughhole 10 is formed between the bottom of the dish 6 and the enclosure 2 to permit the liquid to flow therethrough. The opposite ends of dish 6 which are perpendicular to the axis of the drum 4 form separating walls 11, which are mounted externally of the side walls of the drum 4. The walls 8, 9 and 11 of the dish extend beyond the liquid level but an upper end of the center of the wall 8 is provided with a shallow cutout 12 extending laterally so as to provide an area which lies slightly below the liquid level. Mounted between the casting drum 4 and the cutout 12 of the separating wall 8 is a gate device which can be opened downwardly and which comprises a wall 13 extending to the substantially same level from the liquid surface as that of the walls 8 and 9 and also extending in opposing relation with the cutout 12, and a vertical gate guide 14 which supports the wall 13 and mounted on the bottom surface of the dish 6. The wall 13 supported by the gate guide 14 can slide up and down to adjust an opening 15 at the bottom. Between the respective opposite ends of the gate guide 14 and the respective opposite ends of the cutout 12, there are provided separating walls 16 which extend to the same level from the liquid surface as that of the walls 8 and 9. In this manner, according to the present invention, a conventional casting tank is divided into three compartments, that is, a compartment 17 corresponding to the first separation zone which is bounded by the enclosure 2 and which includes a volume excluding the volume of the dish 6, a compartment 18 corresponding to the second separation zone bounded by the walls 8, 13 and 16 above the dish 6, and a compartment 19 corresponding to the casting zone bounded by the walls 8, 9 and 11.

The molten lead containing the dross is introduced to the compartment 17 through the conduit 1 and the excess amount of the molten lead other than that consumed by casting is flown out of the return ports 3 so that the liquid level in the compartment 17 is kept at a constant level. The molten lead with the dross floating on the surface flows along the liquid surface towards the cutout 12 and beyond the same into the compartment 18, where the dross floating on the surface is separated from the molten lead and only the molten lead is introduced into the compartment 19 through the opening 15 and cast on the surface of the rotating drum 4 having its bottom dipped below the liquid surface in the compartment 19. There occurs substantially no difference between the liquid level in the compartment 17 and the liquid level in the compartments 18 and 19, and only the molten lead in the vicinity of the liquid surface and the dross move through the wide flow path at a low speed. The dross is damed at the upper end of the wall 13 which projects upwardly of the liquid surface and collected at the side thereof. The collected dross may be removed, either continuously or intermittently, by a suitable means.

The introduction of raw material molten lead into the respective compartment prior to casting causes the opening of the gate device to be closed and the compartments 17 and 18 to be filled with the raw material lead up to the level of the return port 3. In this case, the raw material supplied into the compartment 17 flows through the cutout 12 of the wall 8 with the dross floating on the surface and introduced into the compartment 18. By angularly mounting the side wall 8 the flow-in speed can be reduced to facilitate the dross in the compartment 18 to come to the surface. Thus it is possible to introduce the molten lead into the compartment 19 while adjusting the opening of the gate device.

It is thus apparent that the present invention provides an apparatus for manufacturing endless lead sheet from which a cathode starting sheet for electrolytic refining of lead is manufactured, which apparatus includes a casting tank and a cooling drum rotatably mounted in said tank, characterized in that a dish surrounding the bottom of said drum is mounted in said tank, said dish includes at its upper end a shallow, laterally extending cutout, and an adjustable gate device is provided between said cutout and the bottom of the drum.

In the method and apparatus of the present invention, since the molten lead which is substantially free from the dross is introduced into the compartment 19 and the raw material is supplied externally of the separating walls, the liquid surface is not disturbed and a wide endless sheet having uniform thickness can be manufactured in an efficient manner. By way of example, while a sheet of about 700 mm width and 1 – 1.5 mm thickness has been obtained in the prior art method, the present method can provide a sheet of 1100 mm width and 0.5 – 1.0 mm thickness at a rate of 840 m per hour.

Even when the above described apparatus is used in the present method, there may still arise the difficulty in taking up the sheet particularly when a wide endless lead sheet is cast. This results from the generation of new dross in the casting zone and other factors mentioned previously.

According to the present invention, the above difficulty has been overcome by winding up a hard, flexible metal wire together with the cast sheet, after the initiation of winding of the cast sheet, to the extent of ⅓ – ¼ of the sheet width with the center being aligned with the center of the sheet width, in such a manner that the wound combination presents a hill having its top at the center of the sheet width.

Examples of the wire applicable include wires, springs or thick tape of iron, copper, aluminum, zink and the like which may be coated with plastic materials. After the cast sheet has been shaped by a guide roll and then by a pair of rolls and wound on a take-up roll and brought into steady close contact with the roll, the wire is wound up together with the sheet. The wire is preferably wound to the extent of ⅓ – ¼ of the width of the cast sheet with the center thereof being aligned with the center of the sheet width, and the height of the top of the hill is preferably 1/50 – 1/100 of the width of the sheet.

By forming such a hill belt at the center of the cast sheet, the cast sheet is prevented from skewing towards the side of the take-up roll and winding operation is facilitated. Unwinding can also be readily accomplished. When the unwound endless cast sheet is cut and pressed, the slack produced at the center of the sheet results in a number of lateral creases. The strain in the sheet is absored in the crumpled center portion so that the deformation and the deviation can be reduced. By way of example, when a cathode starting sheet of 1080 mm width, 1190 mm length and 1 mm thickness, which is larger in size than a conventionally used sheet, was hung in an electrolytic cell, the deviation with respect to the beam was measured to be 2.90 mm at one end, 2.20 mm at the other end and 2.50 mm at the center thereof. For comparison purpose, a cathode starting sheet manufactured from an endless cast sheet of the same width as the above example but has no hill-shaped slack formed thereon was measured. The resulting deviation was 8.15 mm at one end, 18.75 mm at the other end and 5.40 mm at the center. From the comparison of the two examples the advantage of the present method will be clearly appreciated.

Preferred embodiments of the present invention is given below, although it is not intended that the present invention is limited to any of the particular embodiments.

EXAMPLE 1

The compartments 17, 18 and 19 was previously filled with the molten lead by a proper means. With the casting apparatus as shown in FIG. 1 (total volume of 0.25 $m^3$), the molten lead containing the dross at the temperature of 350°C was introduced through the conduit 1. The casting drum was dipped 3 mm below the liquid surface and rotated at the rate of 13 r.p.m. The cast sheet was stripped by in conventional manner and wound on an take-up roll of 508 mm diameter. The endless cast sheet of 0.53 mm thickness, the deviation thereof being 0.03 mm, and 1100 mm width could be wound to the length of 840 m at the rate of 14 m per minute. By unwinding the sheet and cutting and pressing it, a cathode starting sheet of 1080 mm width, 1190 mm length and 0.53 mm thickness was formed.

EXAMPLE 2

The process of the Example 1 was repeated except that after the cast sheet had been wound on the roll by 4 m, a steel wire of 5 mm diameter and 4 m length was wound together with the sheet so that the wire was interposed between the rolled sheets. The sheet, when unwound, presented the slack of 30cm width and 1.5 cm height.

EXAMPLE 3

An electrolysis was carried out for 4 days using 43 cathode starting sheets of 1080 mm width, 1190 mm length and 0.6 mm thickness, which had been prepared in Example 2, 42 lead bullion anodes of 35 mm thickness and an electrolyte of an aqueous solution containing 55 g per liter of hexa fluorosilicic acid and 250 g per liter of lead hexafluorosilicate, under a condition of 120A/$m^2$ of current density, at a temperature of 28° C, and at an anode distance, center to center, of 110mm. Current efficiency obtained was 95.6 %.

The electrolysis was repeated except that the cathode starting sheets were replaced with sheets prepared by a conventional method. Current efficiency obtained was 65 %.

What is claimed is:

1. An apparatus for manufacturing an endless lead sheet from which a cathode starting sheet to be used in electrolytic refining of lead is prepared, including a casting tank adapted to contain molten lead and dross and a cooling drum rotatably mounted on said tank and partially immersed in the molten lead and dross, characterized by the provision of a dish mounted in said tank and surrounding the bottom of said drum such that a portion of said dish extends above the level of the molten lead and dross, the dish having a laterally extending, shallow cut-out at an upper end thereof, pouring means located externally of said dish to feed molten lead and dross to the casting tank, and a vertically adjustable gate device, a portion of which extends above the level of the molten lead and dross, arranged in the dish between said cut-out and said cooling drum whereby chambers are formed for the separation of the dross from the molten lead.

2. An apparatus as defined in claim 1 wherein said cutout is formed in a side wall of the dish which is parallel with the axis of the drum.

3. An apparatus as defined in claim 2 wherein said side wall is angularly mounted relative to an inner wall of the tank.

4. An apparatus as defined in claim 1 wherein said tank is provided with a return port for defining the liquid level.

* * * * *